US010408527B2

(12) United States Patent
Cho et al.

(10) Patent No.: US 10,408,527 B2
(45) Date of Patent: Sep. 10, 2019

(54) REFRIGERATOR

(71) Applicant: SAMSUNG ELECTRONICS CO., LTD., Suwon-si, Gyeonggi-do (KR)

(72) Inventors: Sung-Jun Cho, Suwon-si (KR); Sung-Wook Kim, Hwaseong-si (KR); Sang Gyu Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 204 days.

(21) Appl. No.: 15/367,893

(22) Filed: Dec. 2, 2016

(65) Prior Publication Data

US 2017/0159991 A1 Jun. 8, 2017

(30) Foreign Application Priority Data

Dec. 4, 2015 (KR) ..... 10-2012-0172363

(51) Int. Cl.
*F25D 23/00* (2006.01)
*F25D 17/06* (2006.01)
*F25D 23/06* (2006.01)

(52) U.S. Cl.
CPC ..... *F25D 23/006* (2013.01); *F25D 17/062* (2013.01); *F25D 17/065* (2013.01); (Continued)

(58) Field of Classification Search
CPC ..... F25D 23/006; F25D 23/00; F25B 39/02
See application file for complete search history.

(56) References Cited

U.S. PATENT DOCUMENTS 3,144,079 A * 8/1964 Mack ..... F25D 25/028 165/168
4,338,994 A * 7/1982 Hewing ..... F24D 3/141 165/168

(Continued)

FOREIGN PATENT DOCUMENTS

EP 0890805 A2 * 1/1999 ..... F25D 23/006
JP 49-1894 1/1974

(Continued)

OTHER PUBLICATIONS

Machine Translation of WO2010115706, Espacenet, Refrigeration Device with built-in part, Schlander, all.*

(Continued)

*Primary Examiner* — Filip Zec
(74) *Attorney, Agent, or Firm* — Staas & Halsey LLP

(57) ABSTRACT

A refrigerator includes a first combining member arranged on a side of a cooling room such that the side of the cooling room and a side of a evaporator are hooked with each other in a first direction and a second combining member arranged on the side of the cooling room, the other side of the evaporator is inserted into the second combining member in a second direction, which is different from the first direction, to combine the other side of the evaporator and the one side of the cooling room. Assembly performance is improved with a combining member that facilitates an evaporator to be combined onto an inner side of a cooling room, and heat exchanging performance is improved by the combining member enabling the evaporator to be combined onto a side of the cooling member with a gap.

20 Claims, 12 Drawing Sheets

(52) U.S. Cl.
CPC ..... *F25D 23/066* (2013.01); *F25D 23/067* (2013.01); *F25D 2201/126* (2013.01)

(56) References Cited

U.S. PATENT DOCUMENTS

| | | | | |
|---|---|---|---|---|
| 5,263,535 | A * | 11/1993 | Philo | F28F 9/013 165/67 |
| 6,997,011 | B2 * | 2/2006 | Gerstner | F25D 23/08 165/171 |
| 2004/0226315 | A1 | 11/2004 | Gerstner et al. | |

FOREIGN PATENT DOCUMENTS

| | | |
|---|---|---|
| JP | 55-149172 | 10/1980 |
| JP | 2001-280805 | 10/2001 |
| KR | 1997-0066449 | 10/1997 |
| KR | 1999-0018881 | 6/1999 |
| KR | 10-2007-0059301 | 6/2007 |
| KR | 10-2008-0079108 | 8/2008 |
| WO | 2010/115706 | 10/2010 |

OTHER PUBLICATIONS

Chinese Office Action dated Oct. 31, 2018 from Chinese Patent Application No. 201611100278.1, 15 pages.
Chinese Office Action dated Jun. 6, 2019 from Chinese Patent Application No. 201611100278.1, 7 pages.

* cited by examiner

210

REFRIGERATOR

CROSS-REFERENCE TO RELATED APPLICATIONS

This application claims priority to and the benefit of Korean Patent Application No. 10-2015-0172363, filed on Dec. 4, 2015, the disclosure of which is incorporated herein by reference in its entirety.

BACKGROUND

1. Field

The disclosure relates to a refrigerator having an improved combination structure of an evaporator.

2. Description of the Related Art

Refrigerators are devices having a storeroom and a cold air supply for supplying cold air into the storeroom to keep groceries fresh.

Temperatures in the storeroom remain within a certain range required to keep the groceries fresh.

The storeroom has an open front, which is shut by a door at ordinary times to maintain the temperature of the storeroom.

The storeroom is partitioned by a partition wall into a freezer chamber on the right and a fridge chamber on the left, the freezer and fridge chambers being opened or shut by their respective doors.

The cold air supplied from the cold air supply arranged behind the storeroom helps keep the temperature in the storeroom.

The cold air supply includes a cooling room where an evaporator for generating cold air is arranged, a blower fan for guiding the cold air generated by the evaporator to be supplied into the storeroom, and a cold air duct for receiving and releasing the cold air guided by the blower fan to the storeroom.

SUMMARY

Additional aspects and/or advantages will be set forth in part in the description which follows and, in part, will be apparent from the description, or may be learned by practice of the disclosure.

The disclosure provides a refrigerator having an improved process by simplifying assembly of an evaporator equipped in a cooling room.

The disclosure also provides a refrigerator with an evaporator combined onto one side of a cooling room with a certain gap.

In accordance with an aspect of the disclosure, a refrigerator may include a main body, a storeroom formed inside the main body with a front open, a cooling room arranged in the back of the storeroom, an evaporator arranged on a side of the cooling room, a first combining member arranged on a side of the cooling room such that the side of the cooling room and a side of the evaporator are hooked with each other in a first direction and a second combining member arranged on the side of the cooling room. The other side of the evaporator is inserted into the second combining member in a second direction, which is different from the first direction, to combine the other side of the evaporator and the one side of the cooling room.

Also, the second direction is perpendicular to the first direction.

Also, the first combining member and the second combining member are arranged on the same plane on the side of the cooling room.

Also, the first combining member is hooked with the evaporator in a vertical direction, and the second combining member is combined with the evaporator by the evaporator inserting into the second combining member in a direction perpendicular to a direction in which the first combining member is combined with the evaporator.

Also, the first combining member is arranged on a side corresponding to the top side of the evaporator, and the second combining member is arranged on a side corresponding to the bottom side of the evaporator.

Also, the first combining member and the second combining member are arranged on both sides of the top side and bottom side of the evaporator in pairs.

Also, the evaporator is hooked with the first combining member, and then combined with the second combining member by being pressed toward the side of the cooling room and inserted into the second combining member.

Also, the first combining member and the second combining member are combined with the evaporator with the same gap in the front-to-back direction.

Also, the cooling room has a cold air supply for supplying cold air generated from the evaporator into the storeroom, and the first combining member and the second combining member are combined on a side of the cold air supply.

Also, the evaporator is arranged at a constant distance from a side of the cold air supply in the front-to-back direction.

In accordance with an aspect of the disclosure, a refrigerator may include a main body, a storeroom formed inside the main body with a front open, a cooling room arranged in the back of the storeroom, an evaporator arranged on a side of the cooling room for generating cold air, a first combining member arranged on a side of a cooling room and hooked on a side of the evaporator and a second combining member arranged on a side of the cooling room with a gap from the first combining member, and combined with the evaporator with the other side of the evaporator inserted into the second combining member.

Also, the evaporator includes a refrigerant tube in a tubular form, in which a refrigerant flows to exchange heat with air inside the cooling room, and the first combining member and the second combining member are combined with a circumferential plane of the refrigerant tube.

Also, the first combining member includes a hook groove facing upward, and the first combining member is hooked vertically with the refrigerant tube arranged on top of the evaporator.

Also, the hook groove is hooked with the evaporator such that the circumferential plane of the refrigerant tube is able to turn against the hook groove.

Also, the second combining member includes an insertion groove facing a direction opposite to the evaporator, and the refrigerant tube arranged below the evaporator is inserted into the second combining member in the front-to-back direction.

Also, the refrigerant tube is inserted into the insertion groove by being pressed to the insertion groove, and the second combining member includes a support projection protruding from an opening of the insertion groove to a direction of enclosing the circumferential plane of the refrigerant tube to support the inserted refrigerant tube.

Also, the first combining member and the second combining member are arranged on both sides of one side and the other side of the evaporator in pairs.

Also, the refrigerant tube includes a plurality of elongated parts each extending in the horizontal direction of the refrigerant tube, and connectors for connecting the plurality of elongate parts in the vertical direction of the refrigerant tube, and a pair of the second combining members are arranged on both sides of one of the plurality of elongate parts, and the one elongate part is inserted into the pair of the second combining members.

In accordance with an aspect of the disclosure, a refrigerator may include a main body, a storeroom formed inside the main body with a front open, a cooling room arranged in the back of the storeroom, an evaporator arranged on a side of the cooling room and including a first area and a second area separated from the first area on the same plane, a first combining member hooked with a part of the first area and a second combining member combined with the second area by a part of the second area inserted into the second combining member.

Here, the part of the first area is combined with the first combining member such that the part of the first area is able to turn in the first combining member, and the part of the second area is combined with the second combining member by being pressed to the second combining member and inserted into the second combining member.

Also, the evaporator is combined with the first and second combining members by being rotationally combined with the first combining member and then inserting the second area into the second combining member while the first area is turned.

BRIEF DESCRIPTION OF THE DRAWINGS

The above and other objects, features and advantages of the disclosure will become more apparent to those of ordinary skill in the art by describing in detail exemplary embodiments thereof with reference to the accompanying drawings, in which.

DETAILED DESCRIPTION

Figure 1:
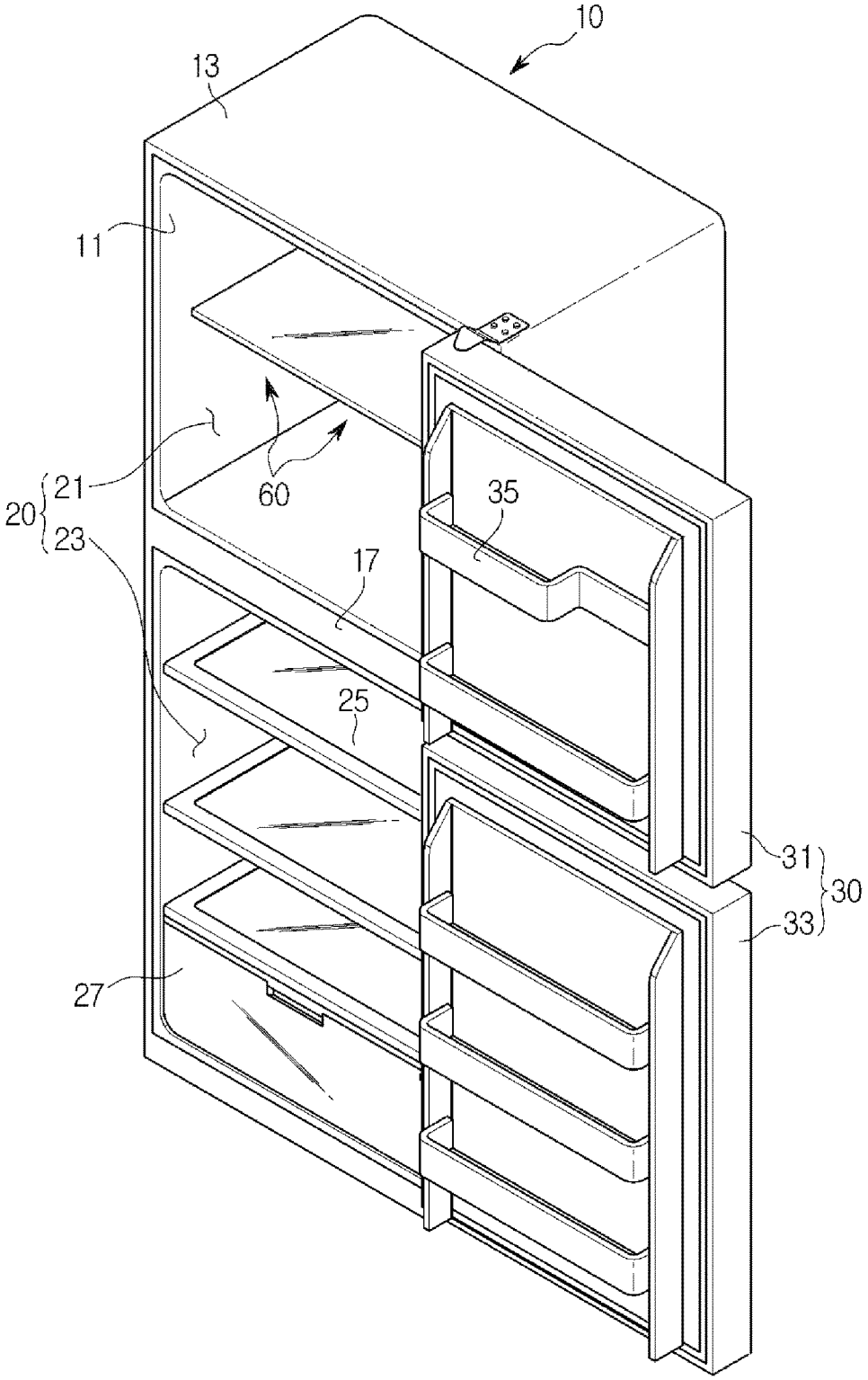
FIG. 1 is a perspective view of a refrigerator, according to an embodiment of the disclosure.

Reference will now be made in detail to example embodiments which are illustrated in the accompanying drawings. The embodiments are described below to explain the disclosure by referring to the figures.

Embodiments and features as described and illustrated in the disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms 'upper', 'upward', 'lower', and 'downward' herein refer to up and down directions based on the upright position of a refrigerator in accordance with embodiments of the disclosure.

As for the terms 'forward', 'front', 'behind', 'rear or back', a direction in which an opening and a door or doors of the refrigerator are arranged refers to a forward direction, and the opposite direction refers to a backward direction.

Reference will now be made in detail to embodiments, examples of which are illustrated in the accompanying drawings, wherein like reference numerals refer to like elements throughout.

Figure 2:
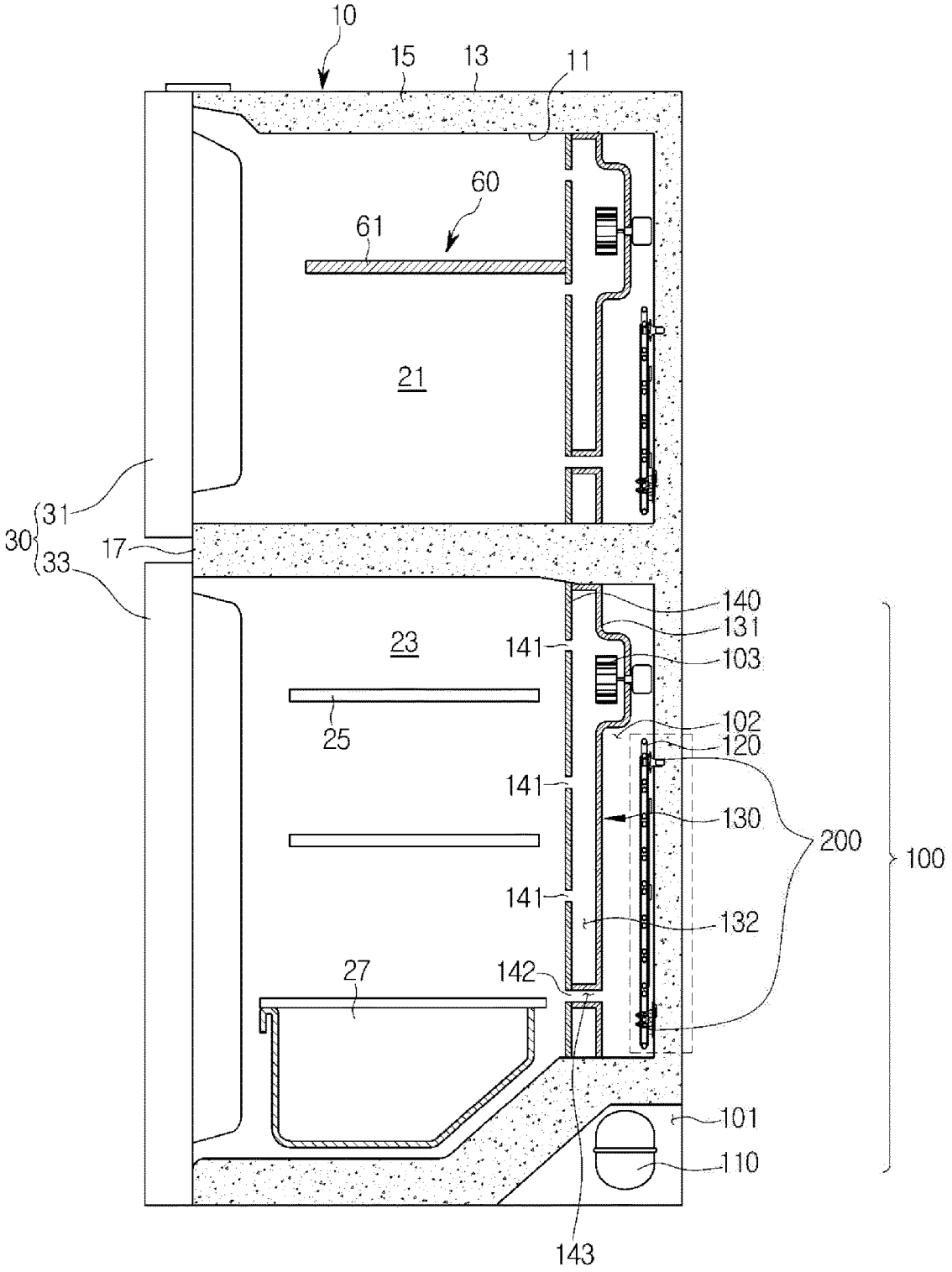
FIG. 2 is a side cross-sectional view of a refrigerator, according to an embodiment of the disclosure.
Figure 3:
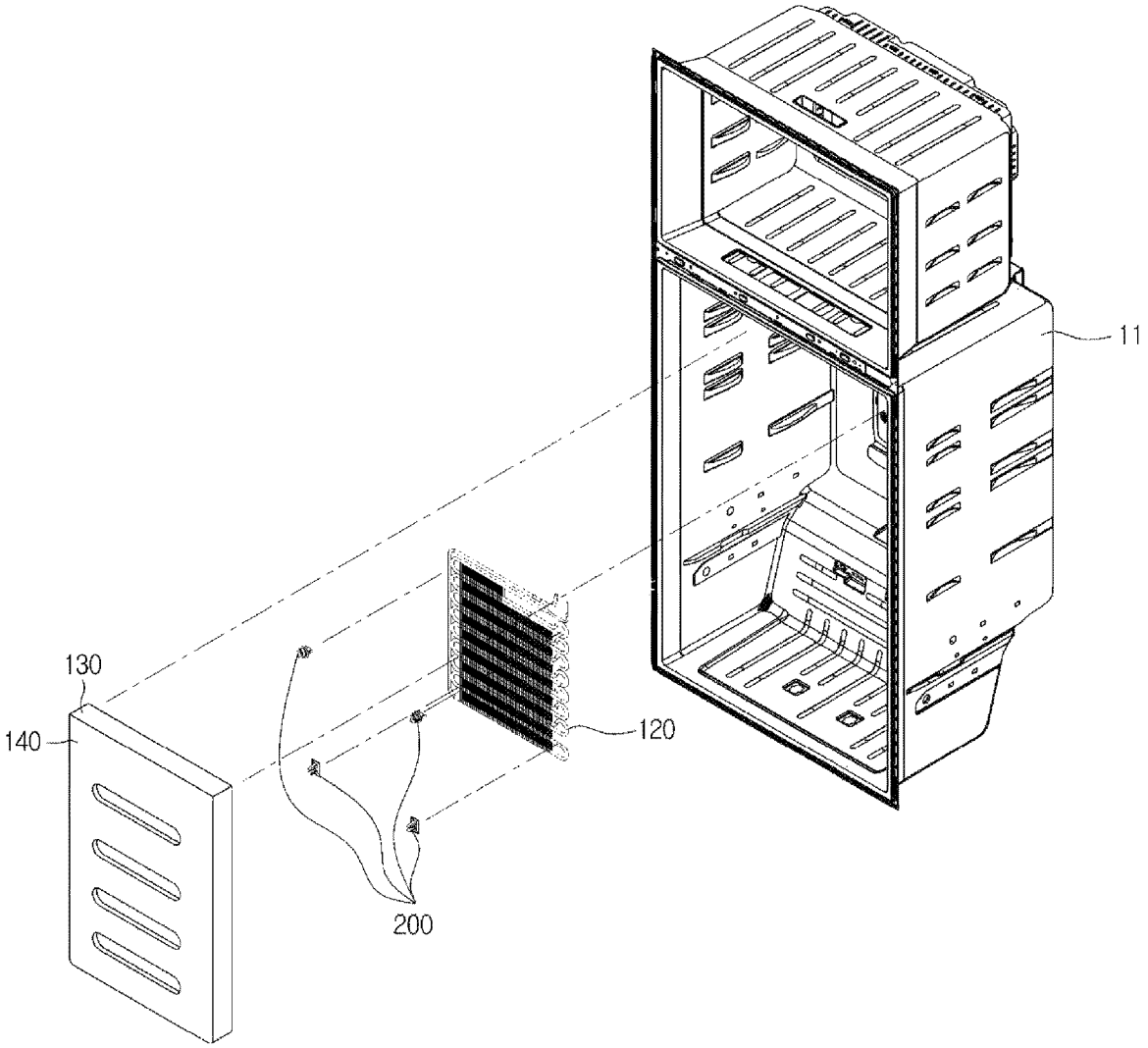
FIG. 3 is an exploded view of some parts of a refrigerator, according to an embodiment of the disclosure.
Figure 4:
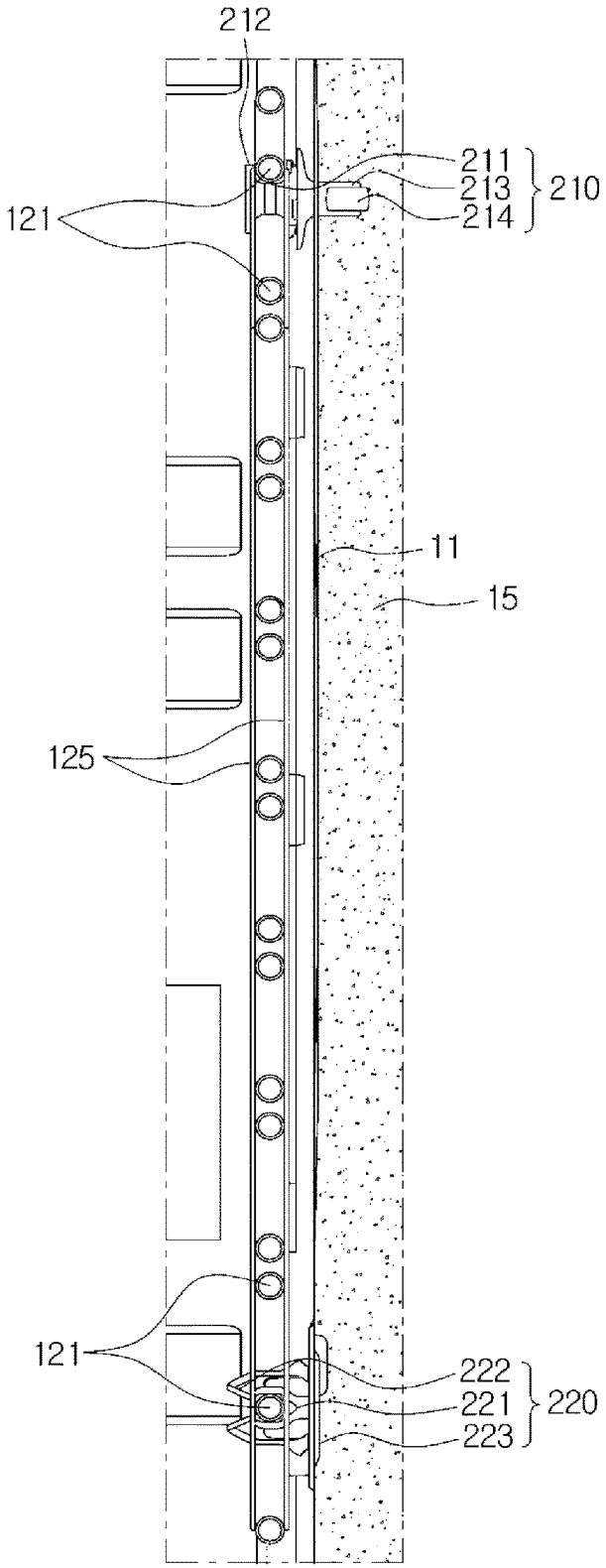
FIG. 4 is an enlarged view of some parts of FIG. 2.
Figure 5:
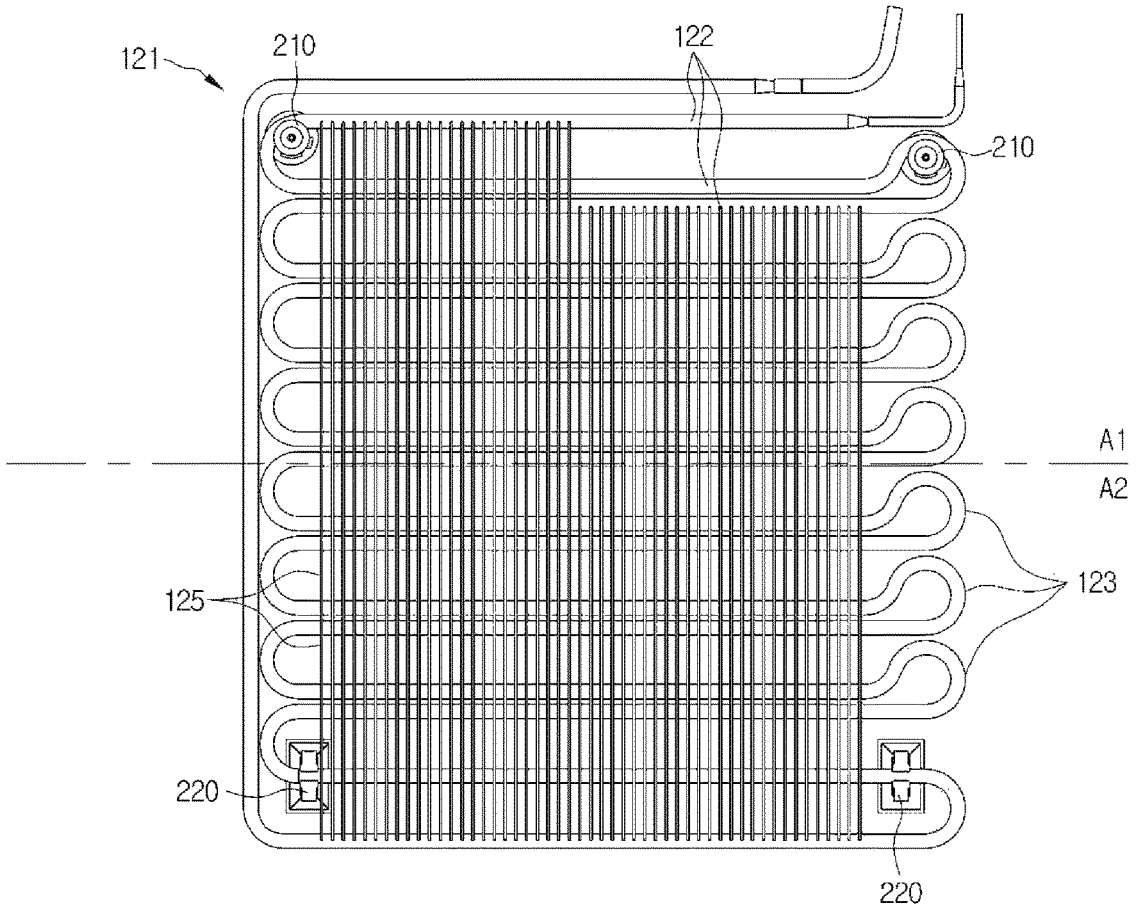
FIG. 5 is a front view of an evaporator of a refrigerator, according to an embodiment of the disclosure.
Figure 6:
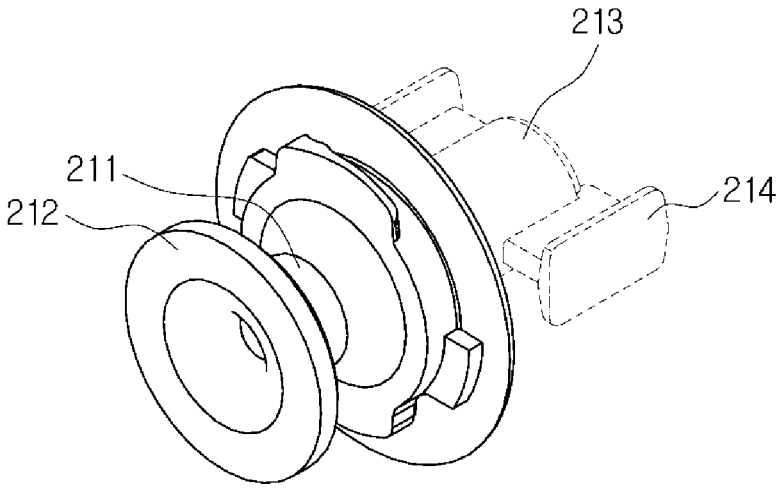
FIG. 6 is a perspective view of a first combining member of a refrigerator, according to an embodiment of the disclosure.
Figure 7:
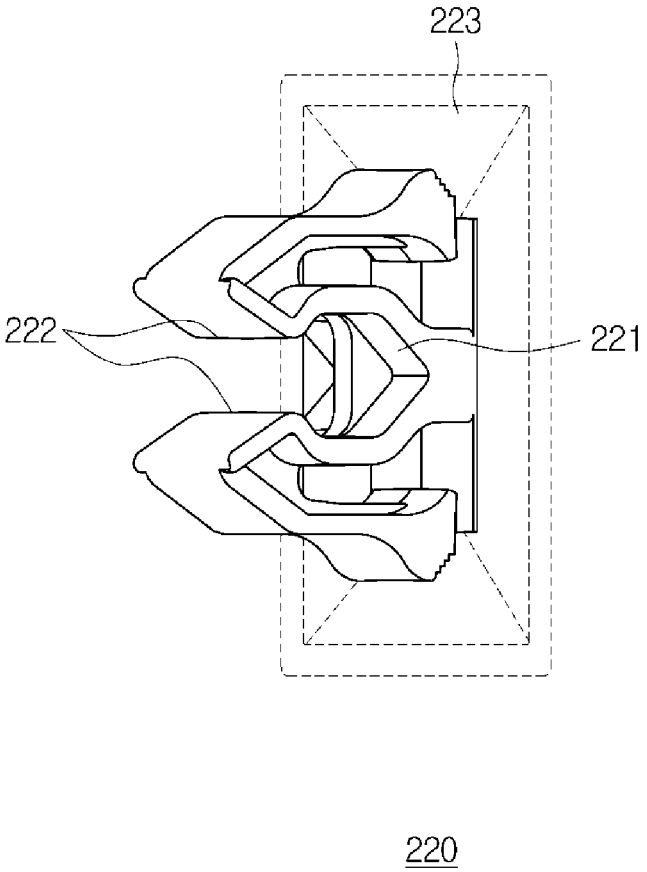
FIG. 7 is a perspective view of a second combining member of a refrigerator, according to an embodiment of the disclosure.

FIG. 1 is a perspective view of a refrigerator, according to an embodiment of the disclosure, FIG. 2 is a side cross-sectional view of a refrigerator, according to an embodiment of the disclosure, FIG. 3 is an exploded view of some parts of a refrigerator, according to an embodiment of the disclosure, FIG. 4 is an enlarged view of some parts of FIG. 2, FIG. 5 is a front view of an evaporator of a refrigerator, according to an embodiment of the disclosure, FIG. 6 is a perspective view of a first combining member of a refrigerator, according to an embodiment of the disclosure, and FIG. 7 is a perspective view of a second combining member of a refrigerator, according to an embodiment of the disclosure.

Referring to FIGS. 1 to 3, a refrigerator may include a main body 10 that forms the exterior, a storeroom 20 with the front open, which is formed inside the main body 10, and a door 30 pivotally combined with the main body 10 to open/shut the open front of the storeroom 20.

The main body 10 may include an inner case 11 that forms the storeroom 20 and an outer case 13 that forms the exterior, and an insulation 15 may be foamed between the inner case 11 and the outer case 13 for preventing cold air from leaking out.

The storeroom 20 may be divided by a partition wall 17 into upper and lower chambers, the upper chamber of the main body 10 forming a freezer 21 and the lower chamber forming a fridge 23. It is not, however, limited thereto, and in some embodiments, the freezer 21 may be formed in the lower chamber while the fridge 23 may be formed in the upper chamber.

In the storeroom 20, there may be a plurality of shelves 25 and containers 27 to store food and groceries in the fridge 23, and one or more shelves 60 (61) in the freezer 21.

The storeroom 20 may be opened or closed by doors 30 pivotally combined with the main body 10, and specifically, the freezer 21 and fridge 23 are opened or closed by freezer and fridge doors 31 and 33, respectively.

On the rear sides of the freezer and fridge doors 31 and 33, a plurality of door guards 35 are arranged to contain groceries.

A cold air supply 100 may be configured to include a compressor 110 and condenser installed in a machine room 101, an evaporator 120 installed behind the storeroom 20 for generating cold air, a cooling room 102 where the evaporator 120 is arranged and air is cooled, a blower fan 103 arranged above the evaporator 120 for guiding cold air generated from the evaporator 120 to be supplied into the storeroom 20, a cold air duct 130 for guiding and releasing the cold air guided by the blower fan 103 into the storeroom 20, etc.

There may be a defrost heater (not shown) arranged below the evaporator 120, and the defrost heater may operate for the cold air to be smoothly discharged into the storeroom 20 by eliminating ice or frost formed in discharging holes 141 when the ice or frost formed in the discharging holes 141 disturbs discharging of the cold air generated from the evaporator 120 into the storeroom 20.

The cold air supply 100 may be arranged in the back of each of the freezer 21 and fridge 23, as shown in FIG. 2, and may have the cooling room 102 including the cold air duct 130 and the evaporator 120, and the blower fan 103.

Features of the cold air supply 100 for the fridge 23 are the same for the freezer 21, so only the features for the fridge 23 will now be described.

The features of the cooling room 102 and evaporator 120 are not limited to an embodiment of the disclosure, but may be selectively arranged in the back of the freezer 21 or the fridge 23. In this regard, if the evaporator 120 is not arranged in the back of the freezer 21 or fridge 23, the cold air duct 130 may extend thereto to receive cold air.

A cover 140 may be arranged in front of the cooling room 102 located in the back of the fridge 23 to be separated from the evaporator 120, dividing the space formed by the cooling room 102 from the internal space of the fridge 23.

The cold air duct 130 may be located between the cover 140 and the evaporator 120 for discharging the cold air generated from the evaporator 120 to the inside of the fridge 23. One side of the cold air duct 130 may be formed by the cover 140 arranged in front of the cold air duct 130.

The cold air duct 130 may include a cold air fluid path 132 formed between the rear side of the cover 140 and the other side 131 of the cold air duct 130 arranged behind the cover 140 with a gap.

As the other side 131 of the cold air duct 130 is arranged in front of the evaporator 120, the cold air duct 130 may be located ahead of the evaporator 120. Accordingly, the fridge 23, the cover 140, the cold air duct 130, a side of which is formed by the cover 140, and the cooling room 102 including the evaporator 120 may be arranged in the enumerated order from the front of the main body 10.

Alternatively, a side of the cold air duct 130 may not be formed by the cover 140 but may be separated from the cover 140, and the order of arrangement is not limited thereto.

The cold air generated by the evaporator 120 flows to the inside of the cold air duct 130 by the blower fan 103, and the cold air may be supplied into the fridge 23 along the cold air fluid path 132.

In the cover 140, there may be a plurality of discharging holes 141 for discharging the cold air generated from the evaporator 120 to the inside of the fridge 23. Accordingly, the cold air flowing along the cold air fluid path 132 may be supplied into the fridge 23 through the discharging holes 141.

Furthermore, the cover 140 may include an inlet 142 through which the air discharged through the discharging holes 141 and having circulated inside the fridge 23 comes in.

The inlet 142 is linked to the cooling room 120 through a suction fluid path 143 connected to the cooling room 103. Accordingly, the circulated air may be sucked into the cooling room 102, may exchange heat with the evaporator 120, and may then flow back into the cold air duct 130 by the blower fan 103.

The cooling room 102 is a space where the evaporator 120 is arranged to generate cold air. The air flowing into the cooling room 102 may exchange heat with a refrigerant while passing the evaporator 120 and thus become cold air. The cooling room 102 may be formed by a space formed by part of the inner case 11 forming the back part of the fridge 23 and the cover 140.

As described above, the cooling room 102 is linked to an inlet 142 formed in the fridge 23 to allow the air circulated in the fridge 23 to flow in, and the air flowing in may exchange heat with the evaporator 120 to become cold air while circulating in the cooling room 102 by the blower fan 103.

Cold air formed by evaporation may flow into the cold air duct 130 by the blower fan 130 while being discharged out of the cooling room 102.

The evaporator 120 may be arranged inside the cooling room 102. The evaporator 120 may be arranged in the cooling room 102 by being combined with a combining member 200 arranged on a side of the cooling room 102, for generating cold air.

Specifically, as shown in FIGS. 2 and 3, the evaporator 120 may be arranged to be adjacent to a side of the cooling room 102 by being combined with the combining member 200 arranged in the inner case 11 that forms the side of the cooling room 102.

In a case of an evaporator of a conventional refrigerator, the evaporator is supported by a support member hooked onto the top of the evaporator and combined to the inner side of the cooling room by screwing the evaporator on a side of the cooling room. In this case, difficult assembly from the process of screwing the evaporator hurts assembly efficiency, and the gap between the evaporator and a side of the cooling room does not remain constant in the front-and-back direction depending on the extent of screwing, causing the air passing the evaporator not to flow smoothly and thus degrading heat exchange performance of the evaporator.

To solve the problem, the refrigerator 1 according to an aspect of the disclosure may include the combining member 200 that facilitates convenient assembly to increase procedural efficiency by eliminating the screwing process and to improve heat exchange performance by maintaining the gap between the evaporator 120 and a side of the cooling room 102 to be constant. The combining member 200 will now be described in detail.

The evaporator 120 may include a tub 121 arranged for a refrigerant to flow therein to exchange heat with air in the cooling room 102 as shown in FIG. 5, and a header (not shown) for supplying or withdrawing the refrigerant to or from the tube 121. There may be a plurality of heat exchange fins 125 arranged to expand areas for heat exchange with air along the circumference of the tube 121.

The tube 121 may include a plurality of elongate parts 122 each extending horizontally and arranged with a vertical gap from another, and a plurality of connectors 123 for connecting the plurality of elongate parts 122 arranged vertically. A refrigerant may exchange heat with air while circulating a refrigerant fluid path formed in the plurality of elongate parts 122 and connectors 123.

The combining member 200 will now be described in detail.

Referring to FIGS. 4 and 5, the combining member 200 may include a first combining member 210 combined in a top area A1 of the evaporator 120 and a second combining member 220 combined in a bottom area A2 of the evaporator 120.

The first combining member 210 may be hooked with the tube 121 arranged in the top area A1. The first combining member 210 may be arranged in a pair, which may be arranged on either side of the top area A1 to be hooked with the evaporator 120. It is not, however, limited thereto, but the first combining member 210 may be two or more in number and arranged on a side corresponding to the top area A1.

The first combining member 210 may include a hook groove 211 sunken inside to be vertically hooked on the circumferential plane of the tube 121. A side of the tube 121 arranged in the top area A1 may be combined with the first combining member 210 by being settled in the hook groove 211. Specifically, a bottom area of the circumferential plane of the tube 121 may be supported by the first combining member 210 by being settled downward in the hook groove 211.

The hook groove 211 is formed to have a circumference corresponding to the circumferential plane of the tube 121 and sunken inside for the tube 121 to be supported to be able to turn while settled in the hook groove 211.

At an end of the hook groove 211, an anti-deviation projection 212 may be arranged to prevent the tube 121 from falling out of the hook groove 211. Accordingly, even if the tube 121 is turned against the hook groove 211, the anti-deviation projection 212 may allow the tube 121 to be turned without falling out of the hook groove 211.

Although a side of the connector 123 of the tube 121 is settled and combined in the hook groove 211 in an embodiment of the disclosure, it is not limited thereto but the elongated part 122 may be settled therein in other embodiments. In this regard, however, the plurality of combining members 210 may support one elongated part 122 in the same places for the evaporator 120 to be supported without leaning toward a side.

Referring to FIG. 6, on the opposite side of the hook groove 211, an inserter 213 may be formed to be inserted into the inner case 11, passing through the inner case 11, and protruding up to between the inner case 11 and the outer case 13. The inserter 213 may be inserted into an insertion hole (not shown) formed in the inner case 11 and may protrude out from the inner case 11, and may be fixed in the inner case 11 by being buried in the insulation 15 when the insulation 15 is foamed.

The inserter 213 may include a fixing wing 214 to widen an area in which the inserter 213 is buried in the insulation 15 in order for the inserter 213 to be more stably supported in the insulation 15. The fixing wing 214 may be buried in the insulation 15 to prevent the inserter 213 from getting out of the insulation 15 while the inserter 213 is turned.

The second combining member 220 may be combined with the tube 121 arranged in the bottom area A2 when the tube 121 is inserted into the second combining member 220. The second combining member 220 may be arranged on either side of the bottom area A2 for either side of the evaporator 120 to be inserted into the second combining member 220. It is not, however, limited thereto, but the second combining member 220 may be two or more in number and arranged on a side corresponding to the bottom area A2.

Specifically, the tube 121 may be combined with the second combining member 220 by being inserted into the second combining member 220 in the front-to-back direction. The first combining member 210 may be combined downward with the tube 121, while the second combining member 220 may be combined with the tube 121 in the front-to-back direction perpendicular to the direction in which the first combining member 210 is combined with the tube 121.

It is not, however, limited thereto, but the first combining member 210 may be combined with the tube 121 in the front-to-back direction or in the left-to-right direction while the second combining members 220 may be combined with the tube 121 in the up-to-down direction or in the front-to-back direction perpendicular to the direction in which the first combining member 210 is combined with the tube 121, as long as the directions in which the first and second combining members 210 and 220 are combined with the tube 121 are perpendicular to each other.

The second combining member 220 may include an insertion groove 221 sunken inside and open to the front for the tube 121 to be inserted into the second combining member 220 from the front toward the back. The second combining member 220 may include a support projection 222 formed to extend from the opening side to support the circumferential plane of the tube 121 in order to prevent the tube 121 from falling out of the insertion groove 221 while the tube 121 is inserted into the insertion groove 221.

A pair of support projections 222 may be arranged on top and bottom sides of the opening of the insertion groove 221, and may extend to a direction to cover the opening from the top or from the bottom. Accordingly, the support projection 222 may limit the tube 121 coming in and out of the insertion groove 221 to an extent.

The second combining member 220 may include an elastic material allowing the support projection 222 to be pushed by the tube 121 to some extent in the vertical direction while the tube 121 is pressed to the insertion groove 221, thereby opening the confined opening, and to be elastically restored to its original position once the tube 121 is inserted into the insertion groove 221, thereby confining part of the opening again.

Accordingly, once the tube 121 is inserted into the insertion groove 221, the support projection 222 may confine part of the opening to prevent the tube 121 from falling out of the insertion groove 221.

As described above, since the second combining member 220 may include the elastic material, it may facilitate insertion of the tube 121 to the side of the second combining member 220 by pressing the tube 121 toward the second combining member 220 in a manufacturing process, and facilitate the tube 121 getting out of the second combining member 220 by pressing the tube 121 in the opposite direction from the second combining member 220.

Referring to FIG. 7, on the opposite side of the insertion groove 221, an inserter 223 may be formed to be inserted into the inner case 11, passing through the inner case 11, and protruding up to between the inner case 11 and the outer case 13. The inserter 223 may be inserted into an insertion hole (not shown) formed in the inner case 11 and may protrude out from the inner case 11, and may be fixed in the inner case 11 by being buried in the insulation 15 when the insulation 15 is foamed.

The elongated part 122 arranged in the bottom area A2 may be inserted to the second combining member 220. Specifically, the second combining member 220 arranged in positions corresponding to either side of the bottom area A2 may be combined in the bottom area A2 by both sides of the single elongated part 122 inserted into the insertion groove 221.

Insertion of both sides of the single elongated part 122 enables the evaporator 120 to not lean toward a side but be supported by the second combining member 220. It is not limited thereto, but the connector 123 may be inserted into the insertion groove 221, in which case the second combining member 220 may be arranged in a position corresponding to the connector 123 in order for the evaporator 120 to not lean toward a side.

A procedure of assembling the evaporator 120 to the combining member 200 will now be described.

Figure 8A:
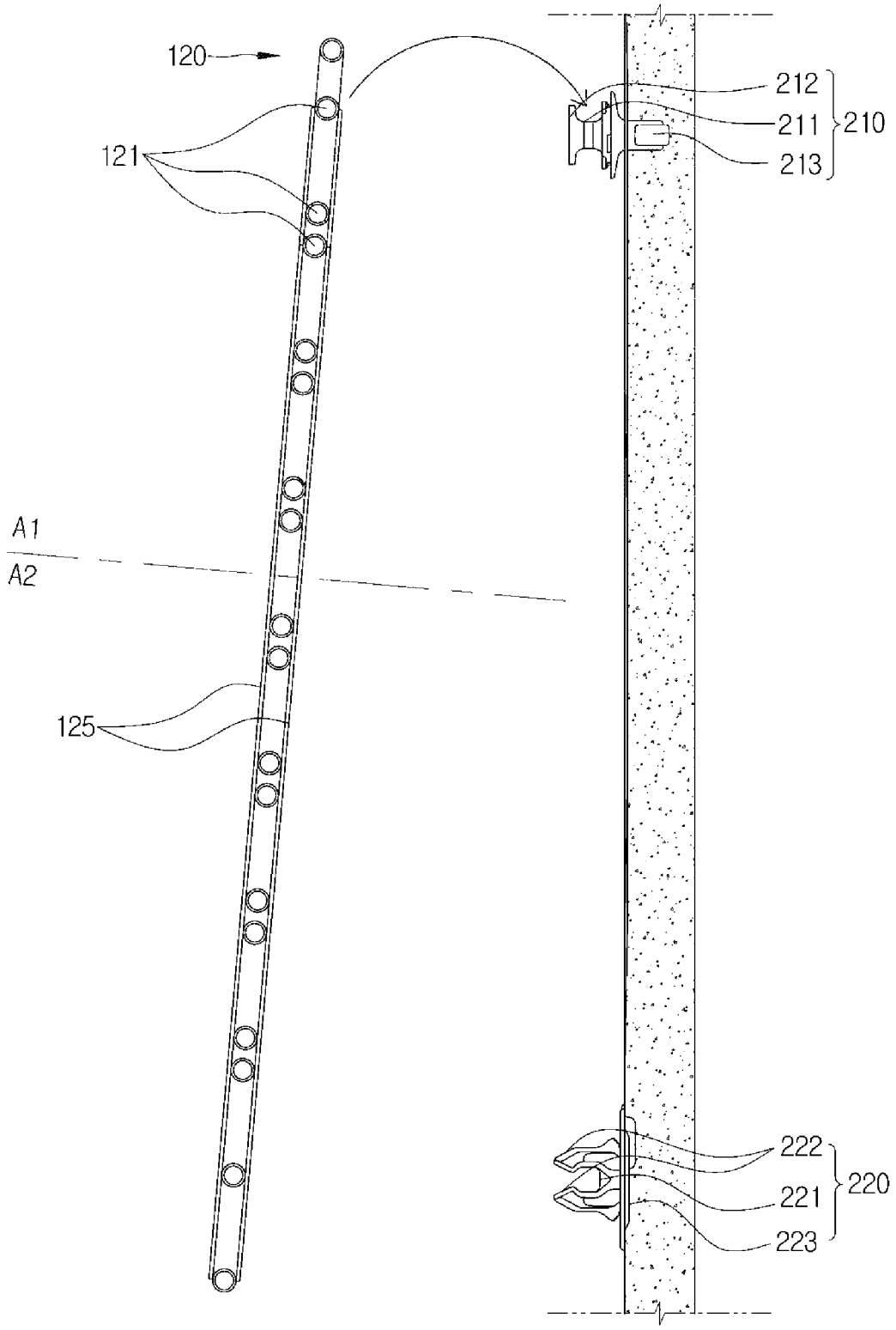
FIGS. 8A to 8C show a procedure of combining an evaporator with a combining member in a refrigerator, according to an embodiment of the disclosure.
Figure 8B:
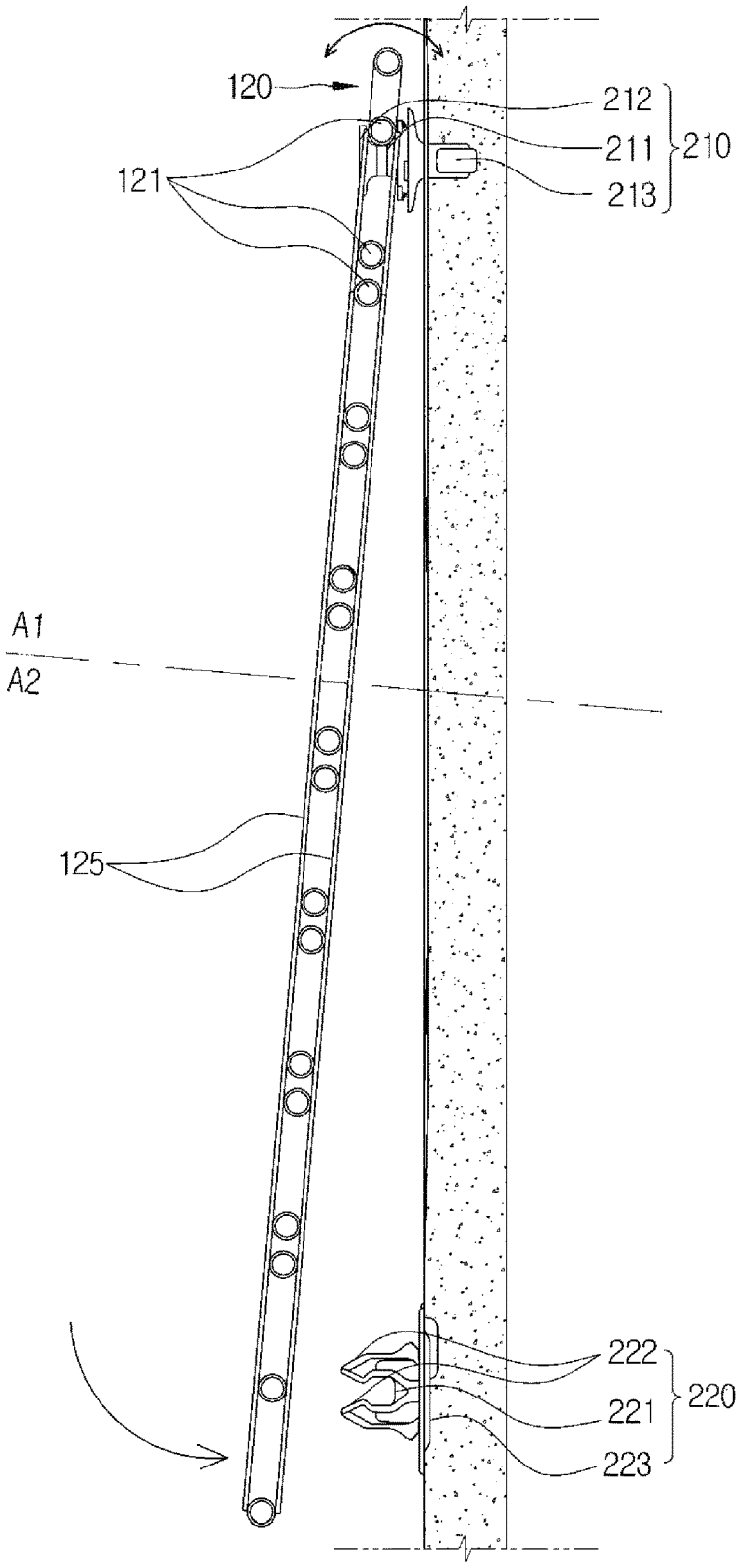
Figure 8C:
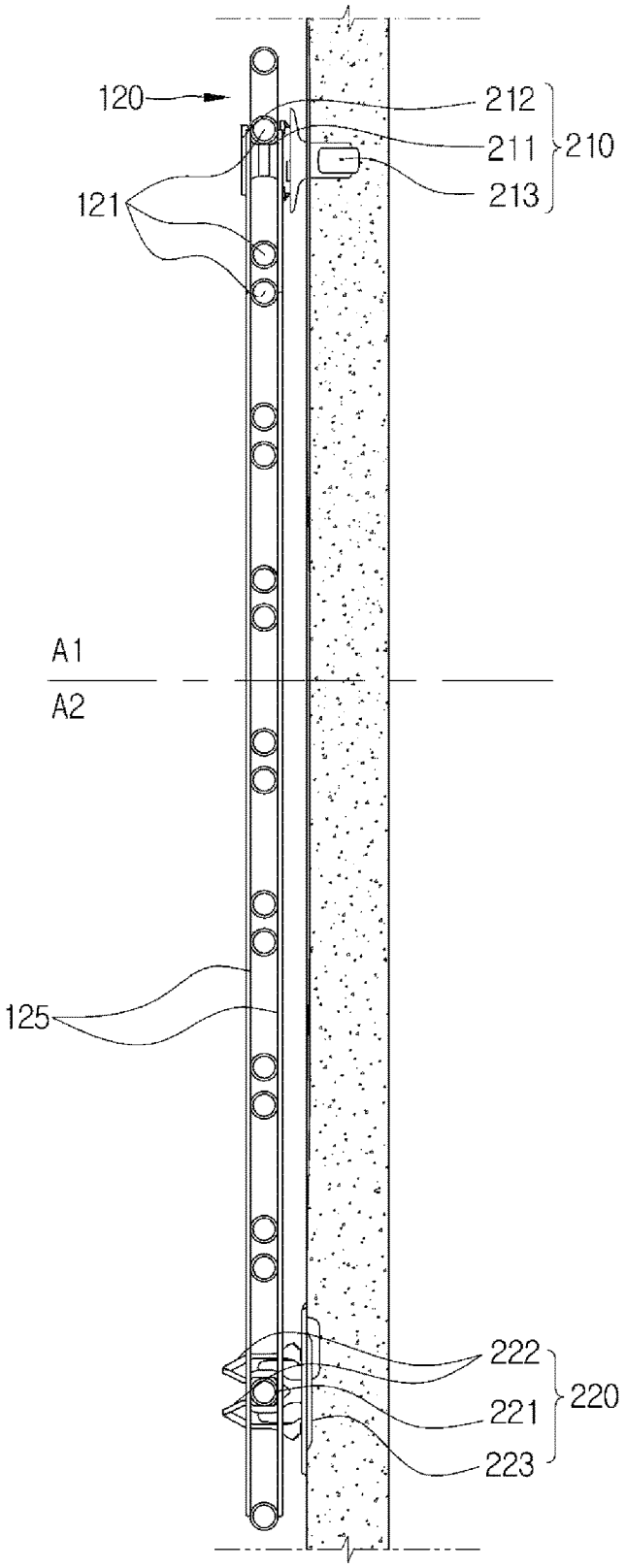

FIGS. 8A to 8C show a procedure of combining an evaporator with a combining member in a refrigerator, according to an embodiment of the disclosure.

Referring to FIG. 8A, while the evaporator 120 is assembled, part of the tube 121 arranged in the top area A1 may be settled in the hook groove 211 of the first combining member 21 in the vertical direction.

The tube 121 settled in the insertion hook groove 211 may be combined with the first combining member 210 such that the tube 121 may be turned against the hook groove 211, as shown in FIG. 8B.

The top area A1 of the evaporator 120 may be able to turn while combined with the first combining member 210, and accordingly, the bottom area A2 may be able to move forward or backward as the top area A1 is turned.

After this, as shown in FIG. 8C, when the bottom area A2 of the evaporator 120 is pressed toward the second combining member 220, the tube 121 arranged in the bottom area A2 may be inserted into the insertion groove 221, thereby combining the second combining member 220 with the bottom area A2.

In other words, the upper part of the evaporator 120 may be rotationally combined with the first combining member 210, pressing the lower part toward the second combining member 220, and accordingly, the first combining member 220 and the evaporator 120 may be combined and supported by a side of the inner case 11.

As such, as the evaporator 120 may be combined on a side of the inner case 11 by a simple pressure, the manufacturing process of assembling the evaporator 120 may be simplified. Furthermore, as described above, without a screwing process performed in the existing assembly of the evaporator, the evaporator 120 may be combined on a side of the inner case 11 with a constant gap as long as the length of the combining member 200, which may enable the air passing the evaporator 120 to flow constantly, thereby improving heat exchange performance.

An assembly structure of an evaporator of a refrigerator will now be described in accordance with an embodiment of the disclosure. Unlike the aforementioned embodiment where the storeroom is partitioned into upper and lower chambers, a storeroom may be divided into left and right chambers in this embodiment of the disclosure. Accordingly, for one chamber of the storeroom, only one evaporator 120 may be arranged behind the chamber. Except this arrangement issue, features of the fridge 20 in this embodiment are the same as those of the refrigerator 1 in the previous embodiment, so the overlapping description will be omitted.

Besides this side-by-side door style refrigerator, the combination structure of the evaporator may be applied to various types of refrigerators, such as French-door style refrigerators.

Figure 9:
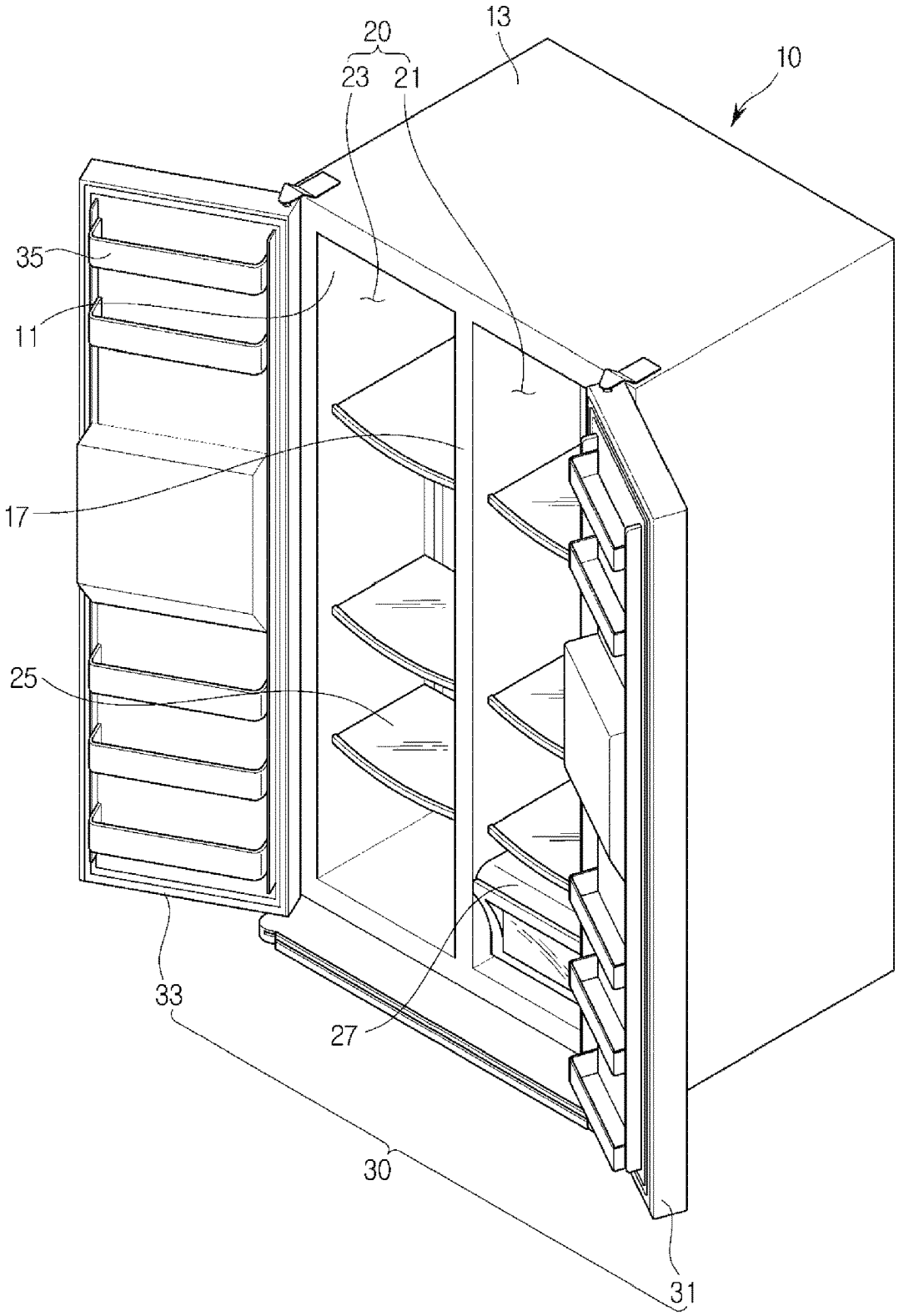
FIG. 9 is a perspective view of a refrigerator, according to an embodiment of the disclosure.
Figure 10:
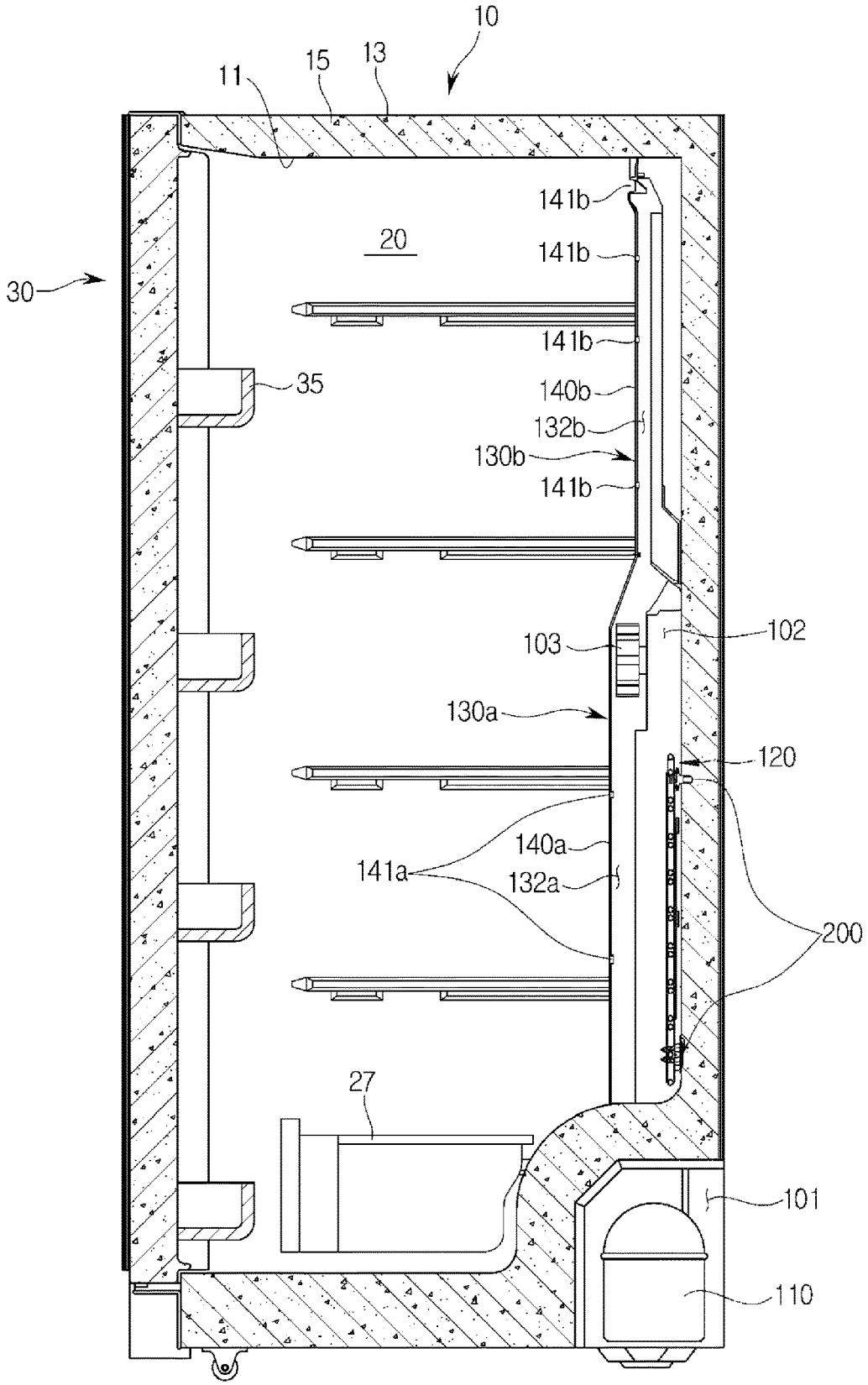
FIG. 10 is a side cross-sectional view of a refrigerator, according to an embodiment of the disclosure.

FIG. 9 is a perspective view of a refrigerator, according to an embodiment of the disclosure, and FIG. 10 is a side cross-sectional view of a refrigerator, according to an embodiment of the disclosure.

The main body 10 may include a partition wall 17 that divides the storeroom 20 into the freezer 21 on the left and the fridge 23 on the right, and the cold air supply 100 for supplying cold air into the storeroom 20 may be arranged behind the storeroom 20.

Referring to FIGS. 9 and 10, the cold air duct 130 may be arranged on the back of the storeroom 20 for guiding the cold air generated by the evaporator 120 to be supplied into the storeroom 20.

The cold air duct 130 may include a lower cold air duct 130*a* arranged in the lower back of the storeroom 20, and an upper cold air duct 130*b* arranged in the upper back of the storeroom 20 on top of the lower cold air duct 130*a*.

The lower cold air duct 130*a* may be equipped with the evaporator 120 and the blower fan 103, and the blower fan 103 may be located above the evaporator 120.

The lower cold air duct 130*a* equipped with the evaporator 120 and the blower fan 103 may further include a first cover 140*a* that forms the front face of a first cold air fluid path 132*a* for guiding the cold air generated by the evaporator 120 to be supplied into the storeroom 20 and forms part of the rear wall of the storeroom 20.

In the first cover 140*a*, there may be a plurality of first discharging holes 141*a* for discharging the cold air delivered along the first fluid path 132*a* into the storeroom 20. Since the lower cold air duct 130*a* is located in the lower back of the storeroom 20, the cold air discharged through the plurality of first discharging holes 141*a* is supplied into the lower part of the storeroom 20.

The upper cold air duct 130*b* arranged on top of the lower cold air duct 130*a* may include a second cover 140*b* that forms a second cold air fluid path 132*b* for guiding the cold air generated by the evaporator 120 to be supplied into the storeroom 20 and forms part of the rear wall of the storeroom 20.

In the second cover 140*b*, there may be a plurality of second discharging holes 142*b* for discharging the cold air delivered along the second fluid path 132*b* into the storeroom 20. Since the upper cold air duct 130*b* is located in the upper back of the storeroom 20, the cold air discharged through the plurality of second discharging holes 141*b* is supplied into the upper part of the storeroom 20.

As described above, since the cold air duct 130 extends vertically, even if the evaporator 120 is arranged behind the lower part of the storeroom 20, the cold air may be supplied to all around the storeroom 20.

The cooling room 102 may be formed in a space formed between the lower cold air duct 130*a* and the inner case 11. On a side of the cooling room 102, i.e., a side of the inner case 11, the evaporator 120 may be installed by the combining member 200. The structure of combining the evaporator 120 by the combining member 200 is the same as what is described above in previous embodiments of the refrigerator 1.

According to one or more embodiments of the disclosure, assembly performance is improved with a combining member that facilitates an evaporator to be combined onto an inner side of a cooling room, and heat exchanging performance is improved by the combining member enabling the evaporator to be combined onto a side of the cooling member with a gap.

Several embodiments have been described but a person of ordinary skill in the art will understand and appreciate that various modifications can be made to these embodiments without departing the scope of the disclosure. Thus, it will be apparent to those of ordinary skilled in the art that the disclosure is not limited to the embodiments described, which have been provided only for illustrative purposes.

Although example embodiments have been shown and described, it would be appreciated by those skilled in the art that changes may be made to these embodiments without departing from the principles and spirit of the disclosure, the scope of which is defined in the claims and their equivalents.

What is claimed is:

1. A refrigerator, comprising:

a main body;

a storeroom formed inside the main body and including an opening at a front side of the storeroom;

a cooling room provided at a rear side of the storeroom;

an evaporator disposed on a first side of the cooling room, the evaporator having a tube;

a first combining member disposed on the first side of the cooling room, the first combining member having a hook groove having a shape corresponding to a circumference of the tube to couple a first side of the evaporator in a first direction to the first side of the cooling room, such that the evaporator is configured to be rotatable with respect to the first combining member in a second direction; and a second combining member disposed on the first side of the cooling room, the second combining member having an insertion groove open to receive and secure the tube to a second side of the evaporator by rotation of the evaporator in the second direction, which is different from the first direction, to couple the second side of the evaporator to the first side of the cooling room.

2. The refrigerator of claim 1, wherein the second direction is perpendicular to the first direction.

3. The refrigerator of claim 1, wherein the first combining member and the second combining member are arranged on a same plane on the first side of the cooling room.

4. The refrigerator of claim 1, wherein the hook groove of the first combining member is hooked to the tube on the first side of the evaporator in a vertical direction, and the second tube on the side of the evaporator is inserted into the insertion groove of second combining member in the second direction which is perpendicular to the first direction in which the first combining member is coupled with the first side of the evaporator.

5. The refrigerator of claim 1, wherein the first side of the evaporator corresponds to an upper side of the evaporator, and the second side of the evaporator corresponds to a lower side of the evaporator.

6. The refrigerator of claim 5, wherein at least one first combining member is disposed on one side of the evaporator in a widthwise direction of the refrigerator and at least one other first combining member is disposed on another side of the evaporator in the widthwise direction, and at least one second combining member is disposed on the one side of the evaporator in the widthwise direction and at least one other second combining member is disposed on the another side of the evaporator in the widthwise direction.

7. The refrigerator of claim 5, wherein the first side of the evaporator is hooked with the first combining member, and the second side of the evaporator is inserted into the second combining member.

8. The refrigerator of claim 1, wherein the first combining member and the second combining member are coupled with the evaporator with a same gap in a front-to-rear direction of the refrigerator.

9. The refrigerator of claim 1, wherein the cooling room includes a cold air supply configured to supply cold air generated from the evaporator into the storeroom, and the first combining member and the second combining member are coupled with a rear side of the cold air supply.

10. The refrigerator of claim 9, wherein the evaporator is spaced apart from the rear side of the cold air supply by a constant distance in a front-to-rear direction.

11. A refrigerator, comprising:

a main body;

a storeroom formed inside the main body and including an opening at a front side of the storeroom;

a cooling room provided at a rear side of the storeroom;

an evaporator disposed on a first side of the cooling room and configured to generate cold air, the evaporator having a tube;

a first combining member disposed on the first side of the cooling room and having a hook groove having a shape corresponding to a shape of a circumference of the tube, the hook groove being hooked to the tube on a first side of the evaporator; and a second combining member disposed on the side of the cooling room and spaced apart from the first combining member, the second combining member having an insertion groove open to receive and secure a second side of the evaporator.

12. The refrigerator of claim 11, wherein the tube of the evaporator is a refrigerant tube in a tubular form, and the first combining member and the second combining member are coupled with a circumferential plane of the refrigerant tube.

13. The refrigerator of claim 12, wherein the hook groove of the first combining member faces upward, and the first combining member is hooked vertically with the refrigerant tube disposed at an upper side of the evaporator.

14. The refrigerator of claim 13, wherein the hook groove is hooked with the evaporator such that the circumferential plane of the refrigerant tube is capable of turning against the hook groove.

15. The refrigerator of claim 12, wherein the insertion groove of the second combining member faces a direction opposite to the evaporator, and the refrigerant tube is disposed at a lower side of the evaporator and is inserted into the second combining member in a front-to-rear direction of the refrigerator.

16. The refrigerator of claim 15, wherein the refrigerant tube is inserted into the insertion groove by being pressed into the insertion groove, and the second combining member includes a support projection protruding from an opening of the insertion groove so as to enclose the circumferential plane of the refrigerant tube to support the inserted refrigerant tube.

17. The refrigerator of claim 12, wherein the first combining member is disposed on one side of the evaporator in a widthwise direction of the refrigerator and another first combining member is disposed on another side of the evaporator in the widthwise direction, and the second combining member is disposed on the one side of the evaporator in the widthwise direction and another second combining member is disposed on the another side of the evaporator in the widthwise direction.

18. The refrigerator of claim 17, wherein the refrigerant tube includes a plurality of elongated parts each extending in the widthwise direction, and connectors connecting the plurality of elongated parts in a vertical direction of the refrigerator, one of the plurality of elongated parts is inserted into the second combining member and the another second combining member.

19. A refrigerator, comprising:

a main body;

a storeroom formed inside the main body and including an opening at a front side of the storeroom;

a cooling room provided at a rear side of the storeroom;

an evaporator disposed on a first side of the cooling room and including a first area and a second area separated from the first area on a same plane;

a first combining member having a hook groove having a shape corresponding to a shape of a circumference of the tube, the hook groove being hooked with a part of the first area of the tube; and a second combining member having an insertion groove open to receive and secure the tube so as to be coupled to the second area by a part of the second area of the tube being inserted into the insertion groove of the second combining member, wherein the part of the first area of the tube is hooked with the hook groove of the first combining member such that the part of the first area is capable of turning in the hook groove of first combining member, and the part of the second area of the tube is inserted into the insertion groove of the second combining member by a pressing force toward the second combining member.

20. The refrigerator of claim 19, wherein the evaporator is coupled with the first and second combining members by the first area being rotationally coupled with the first combining member and then inserting the second area into the second combining member while the first area is turned.

* * * * *